United States Patent [19]

Sandvik

[11] Patent Number: 4,816,129

[45] Date of Patent: Mar. 28, 1989

[54] SUSPENSION ARRANGEMENT FOR ANODE BARS IN CELLS FOR ELECTROLYTIC PRODUCTION OF ALUMINUM

[75] Inventor: Eystein Sandvik, Årdalstangen, Norway

[73] Assignee: Norsk Hydro a.s, Oslo, Norway

[21] Appl. No.: 85,032

[22] Filed: Aug. 13, 1987

[30] Foreign Application Priority Data

Aug. 13, 1986 [NO] Norway ..... 863261

[51] Int. Cl.[4] ..... C25C 3/00

[52] U.S. Cl. ..... 204/243 R; 204/225; 204/286; 204/287; 204/245; 204/297 R

[58] Field of Search ..... 204/225, 242, 286, 287, 204/243 R, 245, 297 R

[56] References Cited

U.S. PATENT DOCUMENTS 3,080,310 3/1963 Lindenmaier et al. ..... 204/286
3,235,478 2/1966 Montovanelto et al. ..... 204/225
3,689,398 9/1972 Caleffi ..... 204/225
4,269,673 5/1981 Clark ..... 204/67

FOREIGN PATENT DOCUMENTS

2111082 A 6/1983 United Kingdom .

*Primary Examiner*—John F. Niebling
*Assistant Examiner*—Kathryn Gorgos
*Attorney, Agent, or Firm*—Wenderoth, Lind & Ponack

[57] ABSTRACT

A suspension arrangement for an anode bar in a cell for electrolytic production of aluminum includes two jacks disposed along the center line of the anode bar, between an anode superstructure and the anode bar. The anode bar is movable in the vertical direction by such jacks which are separately driven, or driven by one common motor. To prevent the anode bar from rotating around its longitudinal axis, there is disposed a torsion device between the anode bar and the anode superstructure. The anode bar is provided with side supporting structure. Which prevents the anode bar from moving sideways.

4 Claims, 3 Drawing Sheets

SUSPENSION ARRANGEMENT FOR ANODE BARS IN CELLS FOR ELECTROLYTIC PRODUCTION OF ALUMINUM

BACKGROUND OF THE INVENTION

The present invention relates to a suspension arrangement for anode bars in cells for the electrolytic production of aluminum. A cell for producing aluminum electrolytically includes a flat steel shell with a carbon lining on the inside. The carbon lining forms the cathode, while the anode, which is also made of carbon, usually in the form of several carbon blocks or elements, fixedly held by anode hangers. The anode hangers are securely attached to an anode bar, providing a firm mechanical as well as electrical connection with the anode bar. Such carbon blocks are usually referred to as anode carbon bodies.

During the electrolytic process the carbon bodies are consumed at their lower ends by the precipitated gases, and to be able to keep a constant distance between the anode and the cathode, the anode bar and the anode carbon bodies have to be simultaneously lowered. The anode bar is provided with vertical regulating means, and when the anode bar has reached the lowermost regulating level, all the anode hangers are removed from the anode bar and temporarily attached to a so-called "crossing bar". The anode bar is then raised to its uppermost positions, whereafter all the anode hangers are reattached to the anode bar in its new position.

In a modern electrolytic cell of up to 250K. ampere, the weight of the anode suspension arrangement may be about 35 tons and the length of the anode bar about 11 meters. Obviously, with such dimensions, the anode suspension arrangement is a large and expensive construction.

The vertical regulating means for the anode bar has to be so constructed that the anode bar may be raised or lowered by parallel movement, or tilted to either end in its longitudinal direction to achieve an inclined position.

The known types of suspension arrangements may roughly be divided into three different groups.

A. Four separate jack devices, of which two at a time are driven by the same motor, are each mounted at one of the end corners of the anode bar. The jack devices are placed on or suspended by separate contruction elements which either stand at the short end of the electrolytic cell or on a self-supported anode superstructure. (If one, instead of two motors are used, it is not possible to tilt the anode bar.)

B. Separate jack devices are each driven by a motor. The jack devices are mounted on a hall floor on the center line of the electrolytic cell, at the short end of the cell, providing an upward movement of the anode bar.

C. One single jack device with a motor is mounted at one of the anode superstructure ends. The jack device controls two mechanisms (one on each side of the anode superstructure, and each attached to one of the beams of which the anode bar is made) and functions as follows: when the jack is moved upwards or downwards, the anode bar is subject to a sheer vertical movement (it is not possible to tilt the anode bar).

These existing arrangements have several disadvantages.

Arrangement A fulfils all functional demands, but when the electrolytic cells are very long, the mechanical load on the anode bar is favorable, which again results in the anode bar being too heavy if deformation stability is to be held within reasonable limits.

Arrangement B is encumbered with the same disadvantage as arrangement A and also must be provided with a sideway support for the anode bar.

Arrangement C provides a favorable location of the suspension points between the anode bar and the mechanisms, so that the mechanical dimensioning of the anode bar may be optimized, but lacks the possibility of lifting the anode bar which is commonly used in connection with the terminations (killing) of anode effect.

OBJECT OF THE INVENTION

It is the object of the present invention to provide an anode suspension arrangement wherein it is possible to optimalize the suspension points for the anode bar and the jack devices as described for the above-mentioned arrangement A, at the same time as the possibility of tilting the anode bar is maintained.

BRIEF DESCRIPTION OF THE DRAWINGS

The invention will now be described in further detail with reference to the accompanying drawings, in which.

DETAILED DESCRIPTION OF THE INVENTION

Figure 1:
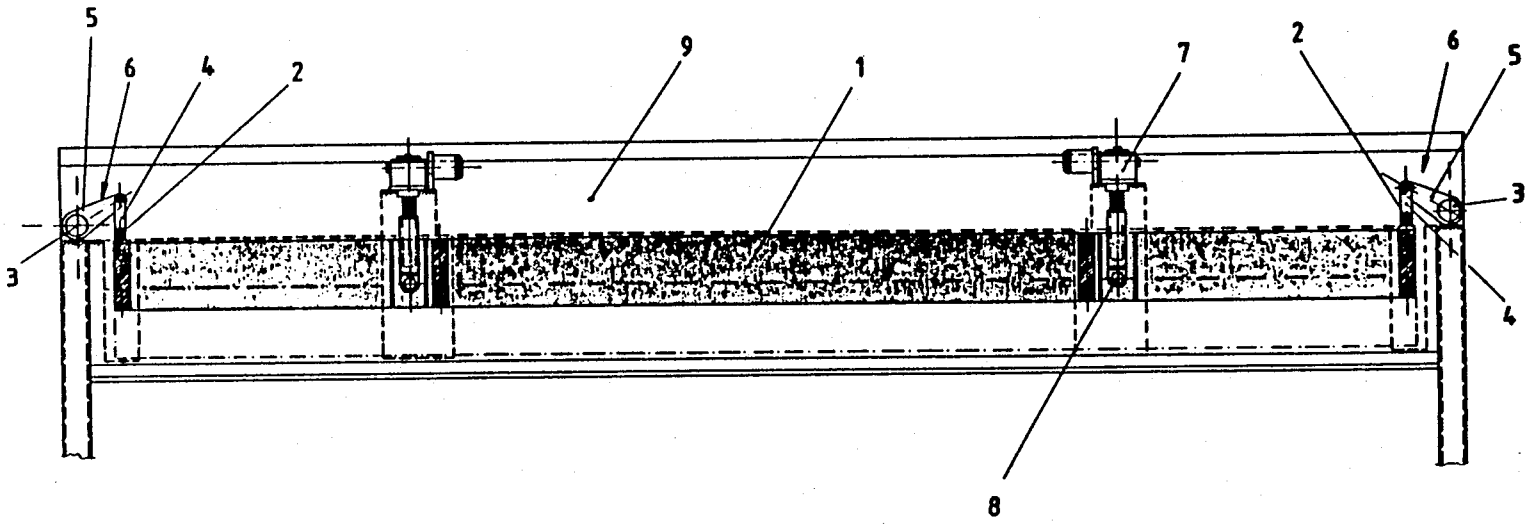
FIG. 1 is a longitudinal view, partly in section, of an anode bar with an anode suspension arrangement according to the invention.
Figure 2:
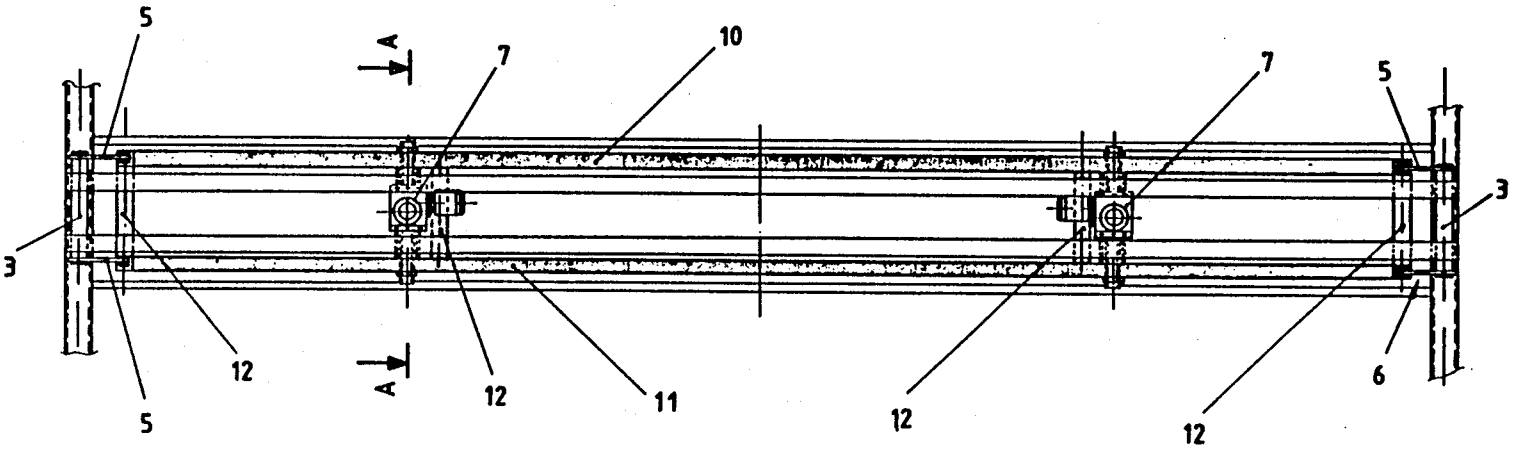
FIG. 2 is a horizontal view of the same.
Figure 3:
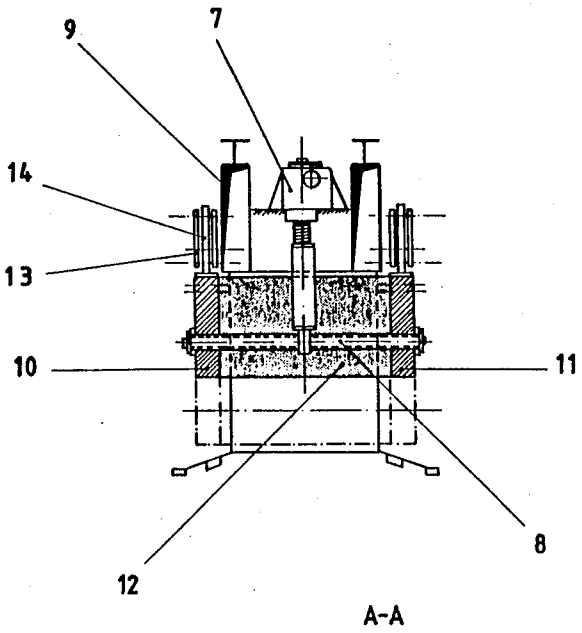
FIG. 3 is a cross-section on a larger scale of the anode bar and the suspension arrangement taken along line A—A in FIG. 2.

An anode bar 1 has a frame construction which comprises two parallel beams 10, 11, formed from aluminum, and which is disposed above an electrolytic cell (not shown) in the longitudinal direction thereof. The two beams 10, 11 are connected to one another by means of cross bars 12 at the ends of the beams, and depending on the length of the beams 10, 11, at one or more points spaced along the longitudinal direction of the beams. In the example shown in FIG. 1, the beams 10, 11, are provided with four cross bars 12.

Anode carbon bodies are connected to the beams 10, 11 in two parallel rows by means of anode hangers (not shown). As the lower ends of the carbons are consumed during the electrolytic process, the consumed carbon is replaced by lowering the anode bar.

A suspension arrangement moves the anode bar in the vertical direction and transfers the forces acting on the anode bar to a self-supported steel construction, the so-called anode superstructure 9, which either is supported by the cathode shell, or independently of this, on a separate building-construction.

The anode suspension arrangement comprises two jack devices 7, which at their lower ends are rotatably attached to, at positions between the beams 10, 11, transversely disposed cross shafts 8, and at their upper ends are connected to the anode superstructure 9. The shafts 8 are disposed between the beams 10, 11 with such distance between one another and the beams that the forces acting on the jack devices are equal, and the strain and stress forces in the beams are the lowest possible. Accordingly, the jack devices 7 are arranged in the vertical symmetry plane between the beams 10, 11.

The jack devices 7 are separately driven, and provide a vertical, parallel movement as well as tilting movement of the anode bar.

To prevent the anode bar from rotating round its longitudinal axis, the ends of the anode bar are provided with torsional devices 6. The torsional devices each include two arm members 4, 5 which are linked to one another. The lower ends 2 of arms 4 are rotatably attached to the respective beams 10, 11, while the free ends of arms 5 are fixedly attached to the ends of a respective torsion shaft 3 which is rotatably disposed on the anode superstructure 9.

The functioning of the torsional devices is as follows. When the anode bar tends to be twisted around its longitudinal axis, the arms 4 on one side of the bar will push the arms 5 on the same side which results in a rotation of the torsion shaft 3. This rotation will, however, be prevented by the arms 4, 5 on the other side of the beams, whereby the anode bar is kept in its same horizontal position with rspect to its axis.

When being used in connection with large electrolytic cell constructions, the anode bar may be provided with additional torsional devices at other places along the anode bar. Whether it is necessary to use more than two torsional devices is, however, regarded as being subject to a constructional matter of judgement.

To be able to withstand the side forces acting on the anode bar, there is diposed a mechanical guiding or supporting arrangement between the anode bar and the anode superstructure 9. Such arrangement may include rollers which are rotatably disposed on the anode bar, for example at each corner thereof, and which can roll against a roll guide on the anode superstructure 9. Or, such arrangement may include guide shoes 14 mounted on the anode bar and which can slide along vertical guideways 13 on the anode superstructure 9.

I claim:

1. In a cell for the electrolytic production of aluminum and including an anode superstructure, an elongated, generally horizontally disposed anode bar supporting anodes, and a suspension arrangement for supporting said anode bar from said anode superstructure for movement relative thereto, the improvement wherein said suspension arrangement comprises:

jack means, including two jacks spaced at positions along the longitudinal center line of said anode bar and supporting said anode bar from said anode superstructure, for selectively lifting or lowering said anode bar vertically relative to said anode superstructure and for selectively lifting or lowering either of the two opposite longitudinal ends of said anode bar relative to the other end thereof;

torsional means, mounted on said anode bar and said anode superstructure, for preventing said anode bar from rotating about the longitudinal axis thereof; and guide means, mounted on said anode bar and said anode superstructure for cooperative engagement, for preventing said anode bar from moving sideways in opposite horizontal directions transverse to said longitudinal axis.

2. The improvement claimed in claim 1, wherein said torsional means comprises, adjacent each said end of said anode bar, a torsion shaft rotatably mounted on said anode superstructure, a pair of first arm members rigidly attached at first ends thereof to respective ends of said torsion shaft, and a pair of second arm members linked at first ends thereof to second ends of respective said first arm members, second ends of said second arm members being rotatably attached to respective sides of said anode bar.

3. The improvement claimed in claim 1, wherein said guide means comprise vertically extending guideways on said anode superstructure, and guide shoes mounted on said anode bar and vertically slidably engaging said guideways.

4. The improvement claimed in claim 1, wherein said guide means comprise vertically extending guides on said anode superstructure, and rollers mounted on said anode bar and vertically rollingly engaging said guides.

* * * * *